United States Patent [19]

Mellor et al.

[11] Patent Number: 4,970,376

[45] Date of Patent: Nov. 13, 1990

[54] GLASS TRANSPARENT HEATER

[75] Inventors: Charles E. Mellor, Salem, Mass.; Kirsten P. Kunz, Durham, N.C.

[73] Assignee: GTE Products Corporation, Danvers, Mass.

[21] Appl. No.: 136,897

[22] Filed: Dec. 22, 1987

[51] Int. Cl.[5] ..... H05B 3/16

[52] U.S. Cl. ..... 219/543; 219/553

[58] Field of Search ..... 219/553, 203, 547, 548, 219/543; 174/68.5; 204/192.26, 192.1; 427/226; 428/432

[56] References Cited

U.S. PATENT DOCUMENTS

| | | | |
|---|---|---|---|
| 4,000,346 | 12/1976 | Dowell | 428/432 |
| 4,006,070 | 2/1977 | King et al. | 428/432 X |
| 4,112,137 | 9/1978 | Zega | 219/121.15 X |
| 4,181,774 | 1/1980 | Wendt et al. | 428/469 X |
| 4,336,295 | 6/1982 | Smith | 428/195 |
| 4,395,622 | 7/1983 | Dran et al. | 219/203 |
| 4,455,089 | 6/1984 | Yeung et al. | 356/361 X |
| 4,462,883 | 7/1984 | Hart | 204/192.26 |
| 4,492,721 | 1/1985 | Joosten et al. | 427/226 |
| 4,583,815 | 4/1986 | Taga et al. | 219/522 X |
| 4,747,674 | 5/1988 | Butterfield et al. | 361/220 X |
| 4,755,659 | 7/1988 | Leon et al. | 219/547 |
| 4,771,167 | 9/1988 | Boulos et al. | 219/547 |

*Primary Examiner*—Bruce A. Reynolds
*Assistant Examiner*—Marvin M. Lateef
*Attorney, Agent, or Firm*—Martha A. Finnegan; Ernest V. Linek

[57] ABSTRACT

A transparent element for the uniform heating of a glass substrate includes: a heating member which is located on one surface of a glass substrate, the heating member including a thin, electrically conductive transparent film; and a thin, transparent antireflection coating applied to the surface of the electrically conductive transparent film. A method of forming a transparent heater for glass cells employed in spectroscopy or signal detection experiments includes the steps of coating a glass cell with first a transparent electrically conductive film; and coating the coated glass cell with a transparent antireflection coating. In a preferred embodiment, the conductive first transparent layer includes indium oxide containing approximately nine molar percent tin oxide and the second antireflection layer includes a highly transparent insulating material such as magnesium fluoride, which has a refractive index that is lower than the refractive index of the glass substrate.

14 Claims, 1 Drawing Sheet

GLASS TRANSPARENT HEATER

BACKGROUND OF THE INVENTION

This invention is directed to means for uniformly heating a glass substrate, especially glass employed where high transparency to visible, or infrared light is required.

In signal detection, spectroscopy experiments, and the like, it is often necessary to maintain an elevated temperature in the test medium. This is conventionally done by (1) placing a transparent glass container, with the experimental material therein, on an electric heater, (2) building an electric heater to fit the outer perimeter of the container, or by (3) placing the container in an oven or hot air stream.

With the above described conventional heating methods, it is generally difficult to maintain a uniform temperature over the surface of the container. For example, a typical glass spectroscopy cell, heated on the rim to 150° C., will have a center temperature of only about 120° C.

In light detection experiments, in addition to heating the container, it is necessary to maintain the transparency of the container so that the medium can be monitored, and any informative light events, e.g., light emissions, reflections, observances or refractions, can be detected, e.g., by the eye or by instrumentation.

SUMMARY OF THE INVENTION

The present invention is directed to means for achieving the uniform heating of glass substrates, especially containers or cells used in spectroscopy or signal detection systems, and most preferably those systems wherein high transparency to visible, or infrared light is required.

The heating means of the present invention comprises first, a heating member on the outside surface of a glass substrate, said heating member comprising an electrically conductive transparent film; and second, an antireflection coating applied to the electrically conductive transparent film. The first film coating provides means for uniformly heating the glass substrate and the later film coating enhances the transparency of the both the electrically conductive transparent film and the glass substrate.

The present invention is also directed to the preparation and use of this construction as a transparent heater for glass cells, and for transparent heater assemblies made for optimized transmission at particular blue wavelengths.

The present invention thus enables the direct heating of glass container surfaces, and maintains or enhances the natural transparency of the glass. In addition, uniform heating of the glass is obtained. Moreover, direct heating is obtained without the use of wires, screens, or external radiant sources, all of which would otherwise obstruct visual and/or instrumental observations and/or measurements.

DETAILED DESCRIPTION OF THE PREFERRED EMBODIMENTS

Figure 1:
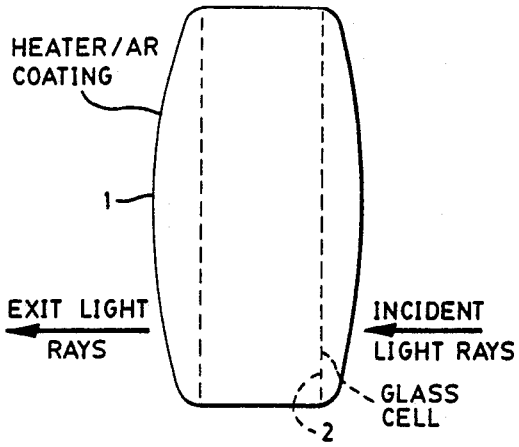
FIG. 1 illustrates a typical pyrex glass cell coated in accordance with the teachings of the present invention.
Figure 2:
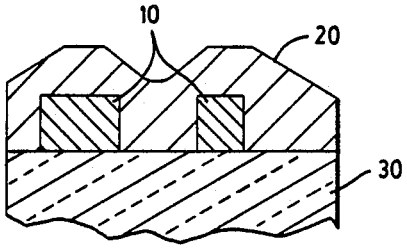
FIG. 2 is a cross-sectional view of a glass substrate coated in accordance with the teachings of the present invention.

As illustrated in the figures accompanying this specification, the present invention is directed to heating means 1 for a glass substrate, especially in the form of a container or cell 2 most preferably a signal detection or spectroscopy cell. See for example, FIG. 1. As illustrated in FIG. 2, the heating means includes a first layer 10 comprising a highly transparent, thin film electrically conductive material, and a second, outermost antireflection layer 20 comprising a highly transparent, thin film electrically insulating material, on a glass substrate 30.

The conductive material used to form the first transparent layer on the glass substrate may be any of the conductive species available to the skilled artisan, so long as the deposited layer does not interfere with the transparency of the glass itself. Examples of conductive materials of this type are well known, for example, in the field of thin film electroluminescent display panels. In especially preferred embodiments, the composition of the conductive layer is indium oxide containing approximately nine molecular percent tin oxide.

Figure 3:
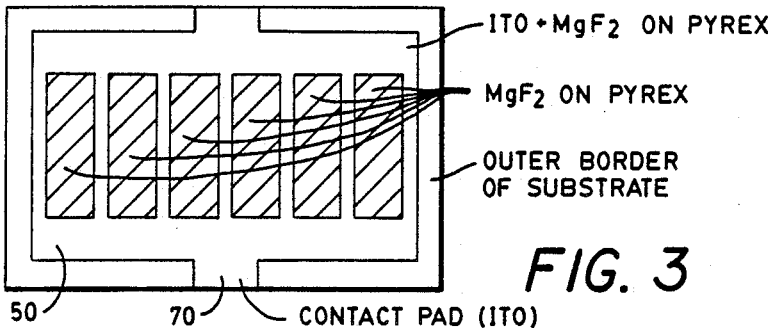
FIG. 3 illustrates a typical electrode layout on a rectangular glass substrate to provide uniform heating thereto.
Figure 4:
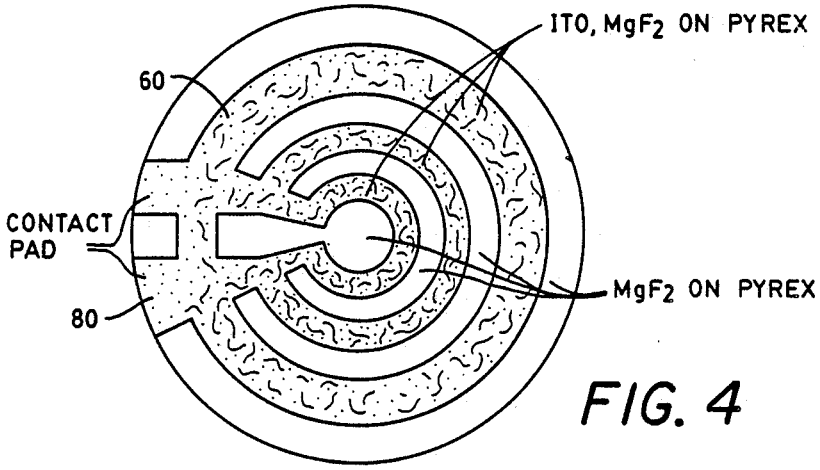
FIG. 4 illustrates a preferred arrangement of a circular heater pattern for glass substrates coated in accordance with the present invention.

After the formation of the electrically conductive thin film layer, a predetermined heater pattern is preferably formed thereon by selectively removing areas of the thin film, preferably by chemical means, although mechanical may be employed, so that the pattern remaining on the glass forms either a single element or multi-element current path. The shape of the current path is unimportant, so long as uniform heating of the glass substrate is obtained. Two current paths 50, 60 are illustrated in FIGS. 3 and 4, respectively by the ITO/$MgF_2$ structure on the substrate. In each of FIGS. 3 and 4, the contact pad 70 and 80, respectively, is in the circuit path.

As is well known, chemical etching can be done by utilizing either a positive or negative photoresist material, which is deposited on the coated substrate, then exposed through a pattern mask, developed and hardened by baking in air for twenty minutes or longer. The material is etched in an acid bath, then the remaining photoresist is cleaned off.

An alternate method for forming the heater pattern on the electrically conductive thin film layer is to imprint the thin film directly on the glass substrate in either the single or multi-element pattern by depositing the film with a pattern mask on the surface of the substrate.

Following the cleaning of the patterned heater element, the entire surface is coated with a second transparent thin film, the so-called antireflection coating. This layer comprises a thin transparent film which has a reflective index less than that of the glass substrate.

In preferred embodiments, this second film layer comprises a highly transparent insulating material, such as magnesium fluoride, which has a refractive index that is lower than the refractive index of the bare section of glass.

In preferred embodiments, this second layer acts as an antireflection coating by reducing the surface reflection from the electrically conductive layer from approximately 7 percent to approximately one half percent, and the surface reflection from the glass substrate itself from approximately 4 percent to approximately 1.5 percent.

In preferred embodiments, the glass substrate is a strong, laboratory grade borosilicate glass, typically transparent Pyrex® glass. The electrically conductive layer is added thereto, preferably by the process of radio-frequency sputtering. The conductive layer is most preferably deposited in a high vacuum machine utilizing magnetically enhanced radio-frequency sputtering. Other deposition processes may be employed, e.g., vapor phase deposition, chemical deposition, and the like.

The second layer is preferably deposited by electron-beam-gun evaporation in a high-vacuum evaporator, although other deposition methods can likewise be employed for this layer also. In one especially preferred embodiment, magnesium fluoride was deposited in approximately one-quarter wavelength in optical thickness.

In preferred processing, a magnetically enhanced sputtering source contains the starting material for the formation of the indium oxide-tin oxide layer (also known as the target). Preferably the target comprises one or more tile-like pieces of indium oxide containing approximately 9 percent tin oxide, or the target may be a pure metallic alloy of indium containing nine percent tin. The target may be fastened to the magnetically enhanced sputtering source by any available means, e.g., by a soldering or epoxy bonding procedure.

In especially preferred embodiments, a thin film electrically conductive layer approximately 2000A (Angstroms) thick is formed by the above-described process on the glass substrate. The refractive index of such a layer is approximately $N=1.85$. This film has an electrical conductivity of approximately 5 ohms/cm$^2$, or a resistivity of approximately $2.5\times10^{-3}$ ohm-cm.

The thickness of this layer may be optimized to provide maximum transmission of several wavelengths of blue visible light. The transmission of the blue visible light is approximately ninety one percent through the the 2000A thick electrically conductive coated Pyrex® glass.

The thickness of the conductive thin film can be altered so that transparency is enhanced for other visible or infra-red wavelengths, e.g., within the range of about 4,000 to about 10,000 Angstroms. The electrical properties of the thin film can be altered so that resistivity is greater that $2.5\times10^{-3}$ ohm-cm to meet any electric power requirements for the heater.

In one preferred embodiment of this invention, the heater was designed to consume approximately 170 milliamperes to reach a temperature of 160 degrees centigrade.

The heater films with antireflection coating of the present invention can be applied to lamp covers, in particular the lens known as "clear" PAR 46, PAR 56, or PAR 64. The lamp covers can then be fabricated into a closed cell, in which an experimental medium may be contained, heated, and analyzed.

In the most preferred embodiments of the present invention, two different heater film types are employed on a given cell. Preferably these two heater films are located on the entrance and exit side of the cell, and are optimized to enhance the transparency of blue light on one side, and enhanced transparency to infra-red light on the second side. In this way, uniform heat is applied to the cell walls, and the transparency of the cell is superior to that of a similar uncoated glass cell.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A transparent element for the uniform heating of a glass container or cell, which element comprises:

a heating member which is located on at least one wall of a container or cell used for spectroscopy or signal detection experiments, said heating member consisting of a single thin, electrically conductive transparent layer patterned to form a current path; and a thin, transparent antireflection coating applied to the surface of the container or cell wall having the patterned electrically conductive transparent layer thereon.

2. The transparent heating element of claim 1, wherein, the heating member further comprises a predetermined single element current path.

3. The transparent heating element of claim 1, wherein, the heating member further comprises a predetermined multi-element current path.

4. The transparent heating element of claim 2, wherein, the glass is a laboratory grade borosilicate glass.

5. The transparent heating element of claim 1, wherein the thickness of the thin, electrically conductive transparent layer is within the range of from about 1000 to 10,000 Angstroms.

6. The transparent heating element of claim 1, wherein the thickness of the thin, electrically conductive transparent layer is about 2000 Angstroms.

7. The transparent heating element of claim 1, wherein the electrically conductive transparent layer is indium oxide containing about 9 percent tin oxide.

8. The transparent heating element of claim 1, wherein, transparent antireflection film is magnesium fluoride.

9. A method of forming a transparent heater for glass cells employed in spectroscopy or signal detection experiments comprising the steps of:

(a) forming a patterned first transparent electrically conductive film consisting of a single layer on a glass cell; and (b) coating the glass cell having the patterned conductive film thereon with a transparent antireflection coating.

10. The method of claim 9, wherein the method of coating the glass cell with the single layer transparent film is by magnetically enhanced radio frequency sputtering.

11. The method of claim 9, wherein the method of coating the glass cell with the antireflection coating is by electron beam gun evaporation.

12. The method of claim 9, wherein the heater pattern is formed during the coating of the glass cell by means of a pattern mask.

13. The method of claim 9, wherein the heater pattern is formed after the coating of the glass cell by the selective removal of a portion of the electrically conductive thin film.

14. The method of claim 13, wherein the removal is accomplished by chemical means.

* * * * *